US007143446B1

(12) United States Patent
Gionfriddo

(10) Patent No.: US 7,143,446 B1
(45) Date of Patent: Dec. 5, 2006

(54) BODY ARMOR FOR PROTECTING THE LOWER BODY

(76) Inventor: Paul William Gionfriddo, 1190 Prospect Ave., Hartford, CT (US) 06105

( * ) Notice: Subject to any disclaimer, the term of this patent is extended or adjusted under 35 U.S.C. 154(b) by 61 days.

(21) Appl. No.: 10/984,330

(22) Filed: Nov. 8, 2004

Related U.S. Application Data

(60) Provisional application No. 60/518,235, filed on Nov. 6, 2003.

(51) Int. Cl.
*F41H 1/02* (2006.01)

(52) U.S. Cl. ..... 2/2.5

(58) Field of Classification Search ..... 2/2.5, 2/94, 102, 69; 224/911, 661, 666, 677
See application file for complete search history.

(56) References Cited

U.S. PATENT DOCUMENTS 4,828,154 A * 5/1989 Clifton, Jr. ..... 224/661
5,215,238 A * 6/1993 Baruch ..... 224/243
5,445,303 A * 8/1995 Cawile, Jr. ..... 224/222
5,765,738 A * 6/1998 Hoffner ..... 224/661
6,149,042 A * 11/2000 Rassias ..... 224/661
6,547,118 B1 * 4/2003 Beletsky et al. ..... 224/661

* cited by examiner

*Primary Examiner*—Tejash Patel
(74) *Attorney, Agent, or Firm*—Holland & Knight LLP

(57) ABSTRACT

A soft body armor garment having an upper portion for covering at least a portion of the lower body of a user, having a lower portion located in proximity to the upper portion which is sufficiently elongated such that the lower portion wraps around to cover at least a portion of the leg of the user; the lower portion having a first and second side, the first side for wrapping around the leg of the user; the second side having an attachment mechanism for securing to the first side around the leg of the user; an attachment mechanism located at the upper portion of the garment wherein the mechanism secures the garment to the user; and at least one receptacle to hold at least one item.

10 Claims, 9 Drawing Sheets

BODY ARMOR FOR PROTECTING THE LOWER BODY

RELATED APPLICATIONS

This application claims the benefit under 35 U.S.C. 119(e) of U.S. Provisional Application Ser. No. 60/518,235 filed Nov. 6, 2003.

FIELD OF THE INVENTION

Various embodiments of the present invention are directed to bullet-resistant garments and methods of making bullet-resistant garments.

More particularly, one embodiment of the present invention is directed to a bullet-resistant garment adapted for protecting specific areas of the body.

Another embodiment of the present invention is directed to a bullet-resistant garment for protecting the upper thigh area of the body and/or lower abdominal area of the body.

For the purposes of the present application the term "bullet-resistant" is intended to refer to being designed to minimize the chances of a fatality or serious injury in the event of a bullet strike (but not necessarily to be impenetrable to all types of bullets under all conditions).

BACKGROUND OF THE INVENTION

Various bullet-resistant garments have been produced. One such type of conventional bullet-resistant garment is known as "soft body armor". Such soft body armor is typically formed of a relatively flexible material (e.g., woven KEVLAR fibers) which acts to provide the principal bullet-resistant characteristics of the garment.

Another type of conventional bullet-resistant garment is known as "hard body armor". Such hard body armor is typically formed of relatively inflexible material (e.g., one or more ceramic plates) carried in pocket(s) in the garment. In this type of body armor the relatively inflexible material acts to provide the principal bullet-resistant characteristics of the garment.

Examples of patents relating to such soft body armor and hard body armor include the following: U.S. Pat. No. 4,266,297 to Atkins (entitled "Bullet Resistant Ballistic Panel Carrier Garment"); U.S. Pat. No. 4,483,020 to Dunn (entitled "Projectile Proof Vest"); U.S. Pat. No. 4,485,491 to Rasmussen (entitled "Method Of Fitting A Ballistic Panel Carrying Garment"); U.S. Pat. No. 4,507,802 to Small (entitled "Adaptive Ballistic Panel Carrying Garment"); U.S. Pat. No. 5,127,105 to Sacks (entitled "Protective Garment"); U.S. Pat. No. 6,389,594 to Yavin (entitled "Anti-Ballistic Ceramic Articles"); and U.S. Pat. No. 6,418,832 to Colvin (entitled "Body Armor").

BRIEF DESCRIPTION OF THE DRAWINGS

FIG. 6 shows the interior face of a right-leg bullet-resistant garment (particularly adapted for protecting the lower body) and FIG. 7 shows the external face of the same bullet-resistant garment described in FIG. 6, incorporating a receptacle to hold, carry or transport at least one item;

FIG. 8 shows the interior face of a left-leg bullet-resistant garment (particularly adapted for protecting the lower body) and FIG. 9 shows the exterior face of the bullet-resistant garment described in FIG. 8, incorporating a receptacle to hold, carry or transport at least one item.

Figure 1:
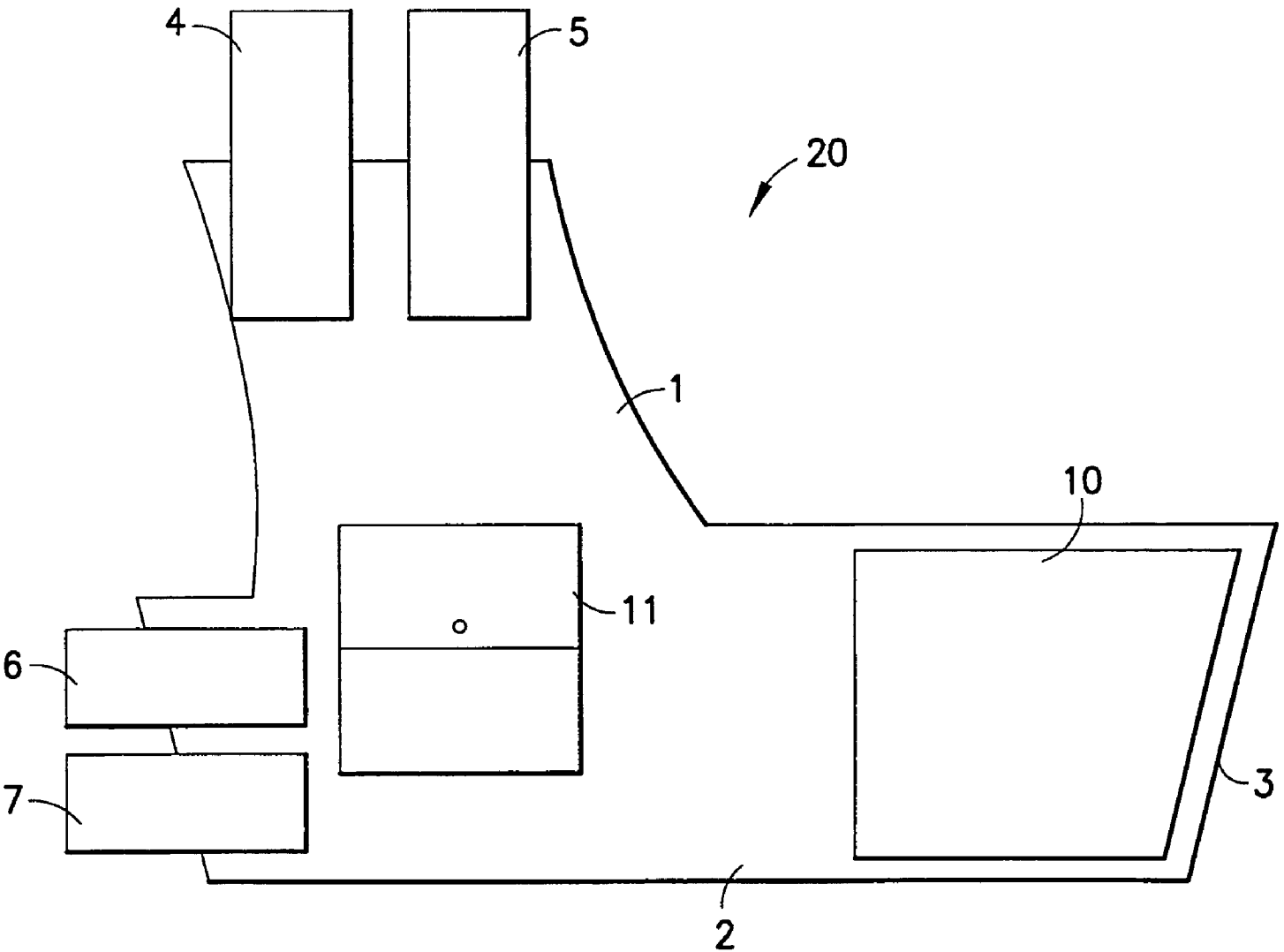
FIG. 1 is one embodiment of the present invention showing an illustration of the external side of a right leg bullet-resistant garment (particularly adapted for protecting the lower body) incorporating a receptacle to hold at least one item according to one embodiment of the present invention.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

In one embodiment, the garment of the present invention comprises a soft body armor, having an upper portion for covering at least a portion of the lower body of a user, having a lower portion located in proximity to the upper portion which is sufficiently elongated such that the lower portion wraps around to cover at least a portion of the leg of the user; the lower portion having a first and second side, the first side for wrapping around the leg of the user; the second side having an attachment mechanism for securing to the first side around the leg of the user; an attachment mechanism located at the upper portion of the garment wherein the mechanism secures the garment to the user; and at least one receptacle to hold at least one item. In a specific embodiment, the lower body of the user is the lower torso area covering including at least the thigh and abdomen. In another specific embodiment, the attachment mechanism located at the upper portion of the garment is at least one strap on the upper portion of the garment that is fastened to the user's belt or pants to secure the garment on the user. In another specific embodiment, the attachment mechanism for securing to the first side around the leg of the user is adjustable. In a further embodiment, the attachment mechanism is selected from the group consisting of at least one: (a) snap; (b) zipper; (c) hook-and-loop fastener; (d) buckle; and (e) Velcro member. In another example, the receptacle includes one or more receptacles for carrying a magazine of ammunition, a gun or a weapon.

The present invention is described in relation to its use as a type of body armor providing protection to the lower body region of the user, which includes the regions of the body below the waist. One embodiment of the present invention is constructed, at least in part, of soft body armor, and may cover, for example, the lower torso area, including at least the thigh and abdomen. Another embodiment of the garment may be constructed such that it does not hinder the mobility of the leg or torso of the user. In another embodiment, a pair of straps on the upper portion of the garment are fastened to the user's belt or pants to secure the garment on and/or to the user; such straps can be flexible, meaning the straps are constructed of material which bends and provides a broad range motion. In another embodiment, the straps may also stretch.

In yet another embodiment, the garment is constructed with an upper portion covering the abdominal regions of the user and with a lower portion covering the leg of the user. In a different embodiment, the garment is secured onto the user by one or more straps at the upper portion and one or more straps at the lower portion providing protection to the lower body region of the user. In one embodiment of the present invention, the bullet-resistant garment is worn over the user's pants. In yet another embodiment of the present invention, the bullet-resistant garment is incorporated into the user's pants.

In another embodiment of the present invention (which example is intended to be illustrative and not restrictive), the bullet-resistant garment is made adjustable with one or more mechanisms including, but not limited to, for example: (a) one or more snaps; (b) one or more zippers; (c) one or more hook-and-loop fasteners; (d) one or more pockets; (e) one or more elastic members; (f) one or more buckles; and/or (g) one or more Velcro members.

In another embodiment, the straps attached to the upper portion of the garment are fixed, for example, to, on or around the belt of the user by one or more Velcro members, providing adjustability of the garment and secure fit for the user. FIGS. 1–5 are examples of such an embodiment.

FIG. 1 illustrates a bullet-resistant garment 20 for protecting the lower body. In one embodiment, garment 20 includes an upper portion 1 and a lower portion 2 with an elongated area 3 of the lower portion. Straps 4 and 5 of FIG. 1 are in one embodiment used to attach garment 20 to the belt of a user, while straps 6 and 7 attach to the lower elongated portion 3 at an attachment point 10, which in this example is a Velcro attachment system used to secure the lower elongated portion 3 of the garment around the leg of the user. FIG. 1 also illustrates receptacle 11, which in this example is a pouch attached on the exterior of the garment 20.

Figure 2:
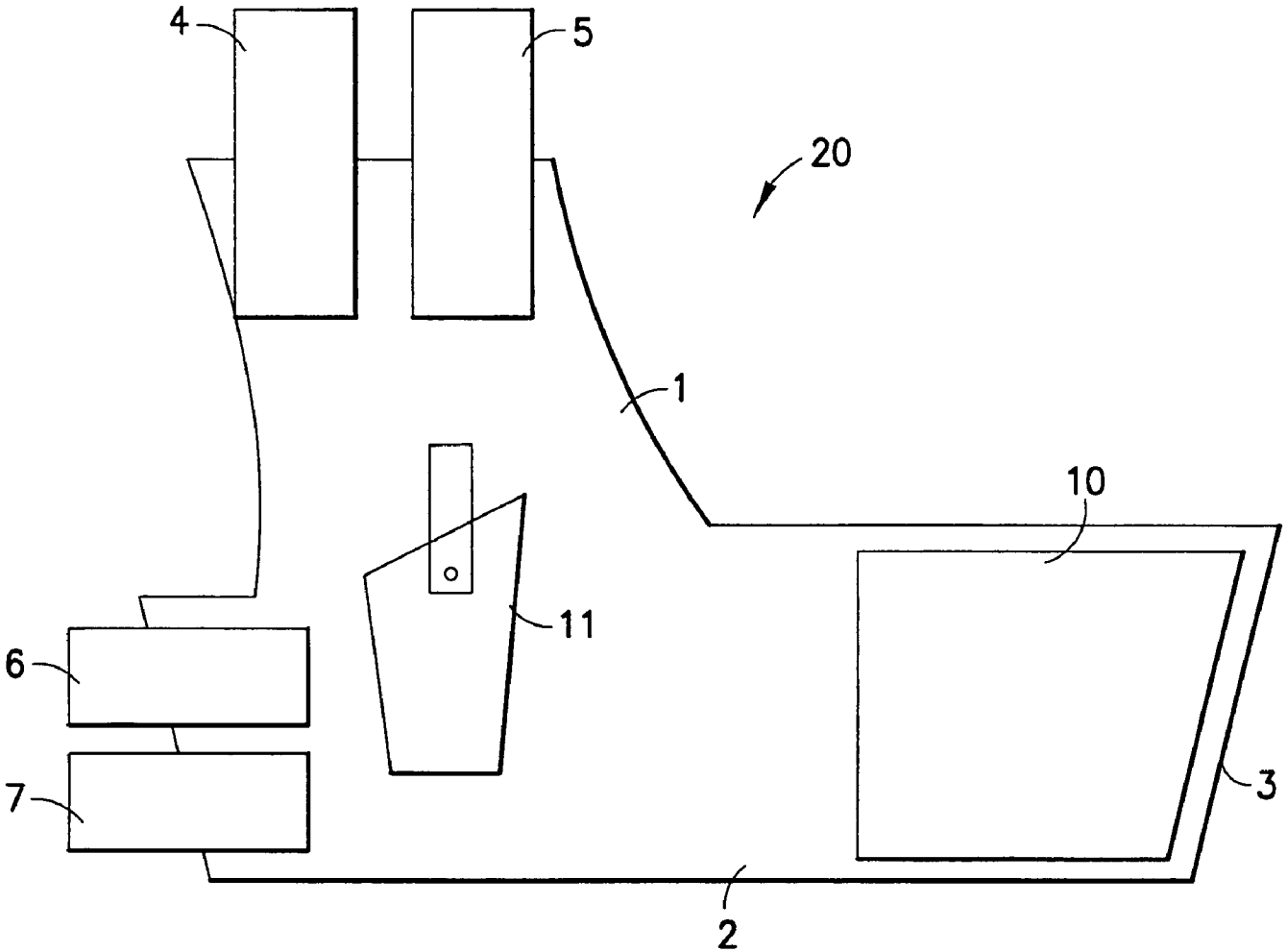
FIGS. 2, 3, 4 are illustrations of additional embodiments of the present invention described in FIG. 1, where each Fig. shows the incorporation of a different receptacle.

FIG. 2 illustrates another embodiment in which receptacle 11 may constitute a weapon transporting system.

Figure 3:
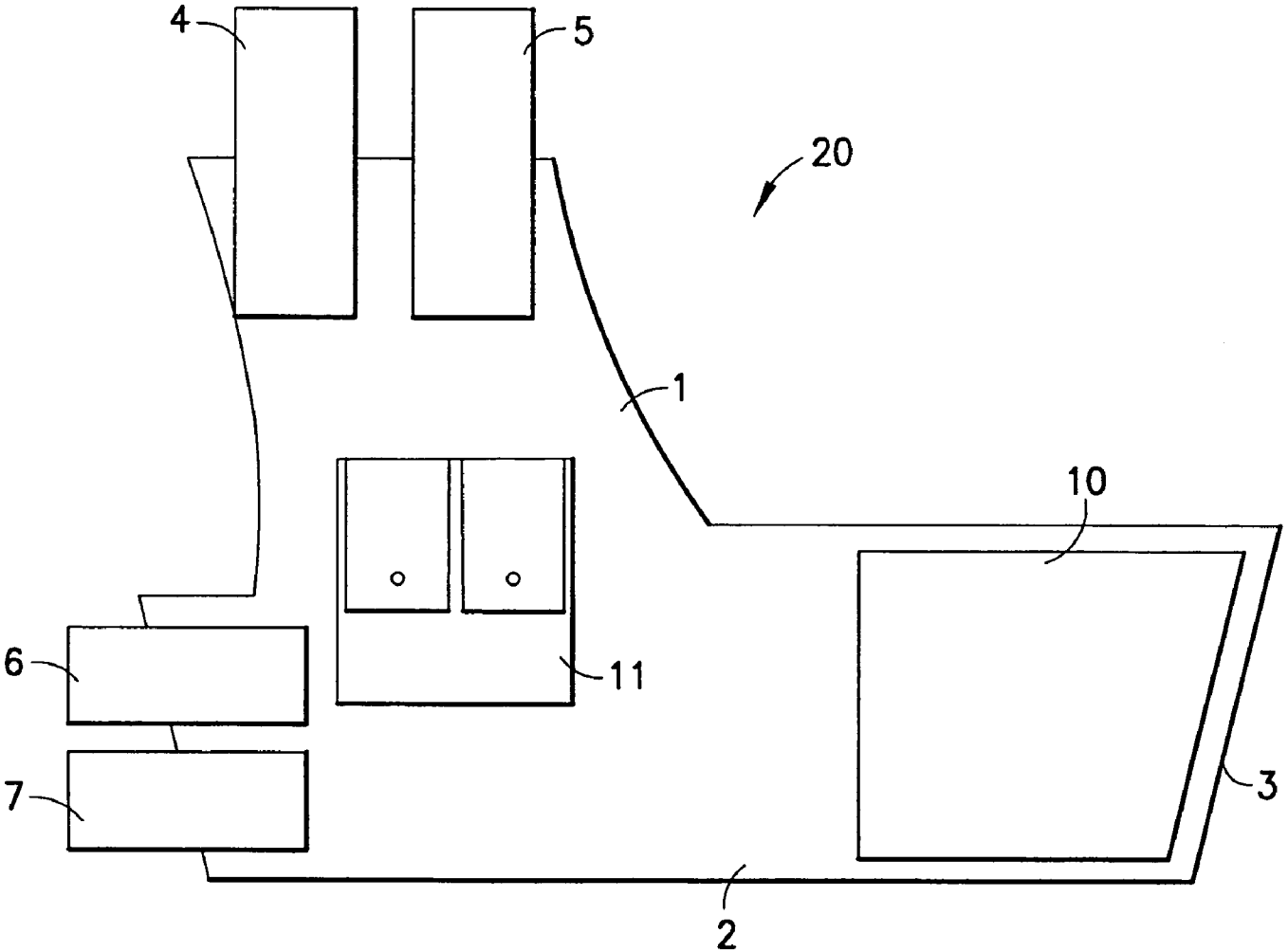

FIG. 3 illustrates another embodiment in which receptacle 11 may comprise a multiple compartment receptacle.

Figure 4:
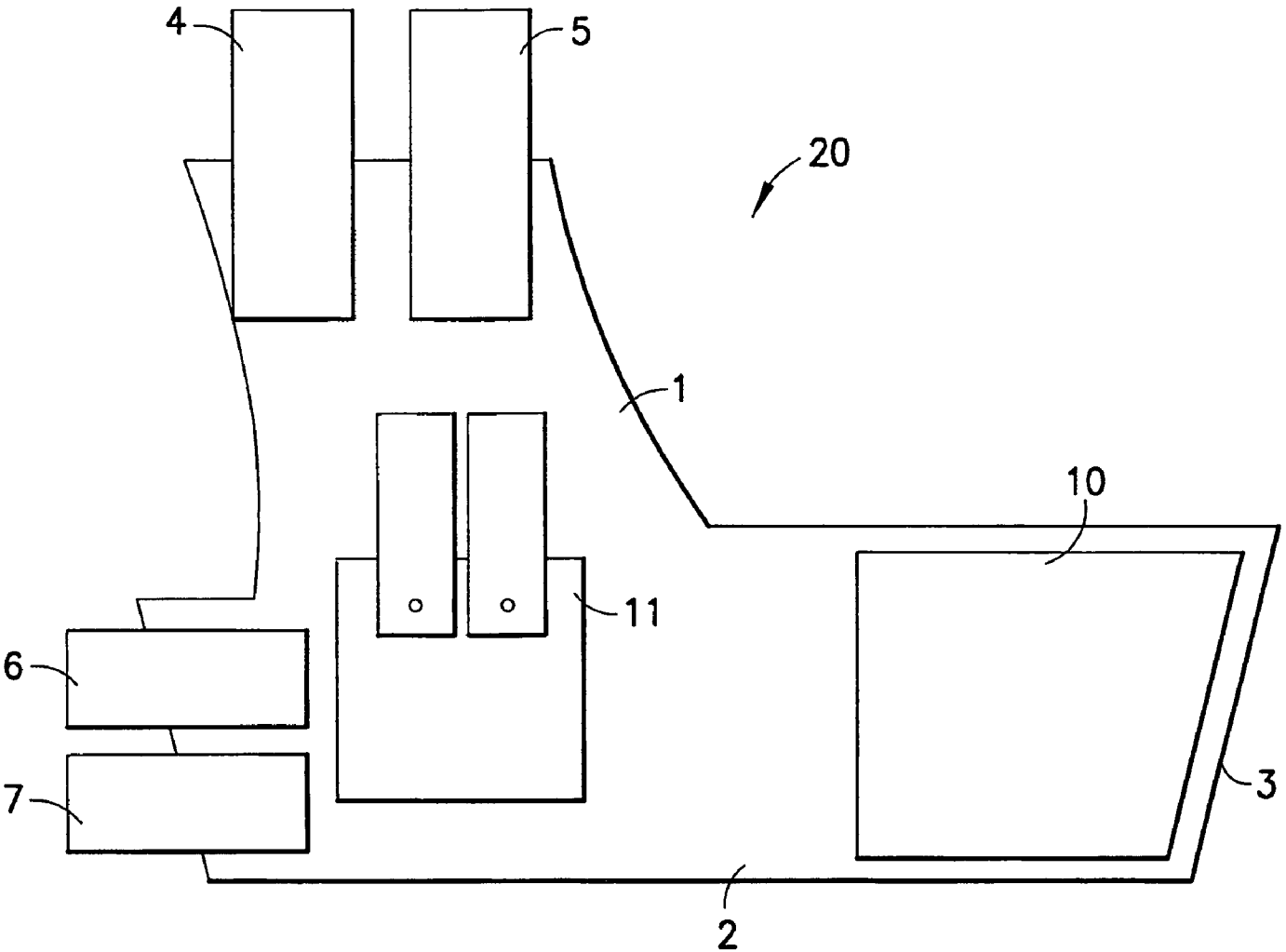

FIG. 4 illustrates another embodiment in which receptacle 11 may be a large multiple compartment receptacle.

Figure 5:
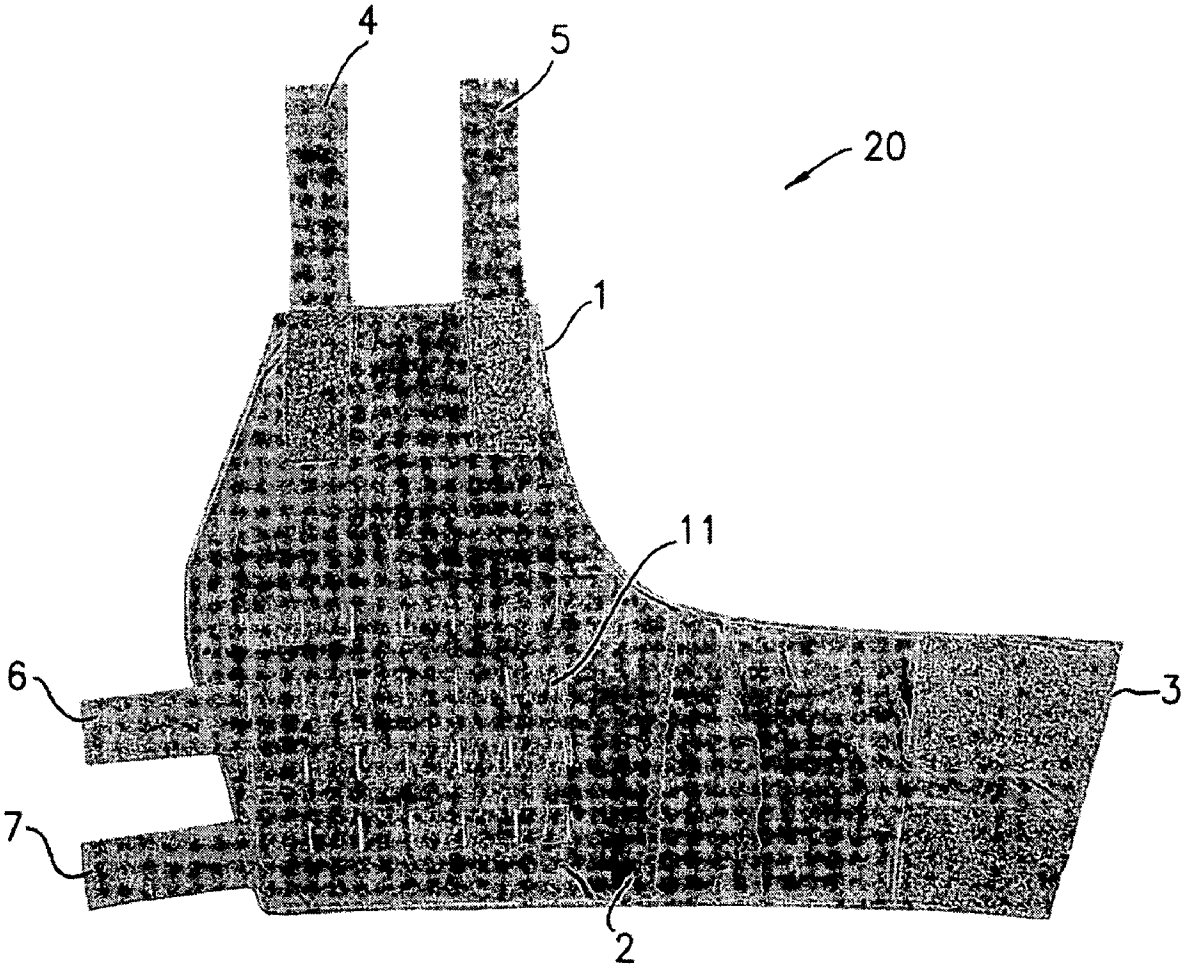
FIG. 5 is another embodiment showing a photograph of the front view of the external face of a right-leg bullet-resistant garment (particularly adapted for protecting the lower body) incorporating a receptacle to hold, carry or transport at least one item according to another embodiment of the present invention.

FIG. 5 shows a different embodiment in which receptacle 11 may constitute a multiple-use receptacle.

Figure 6:
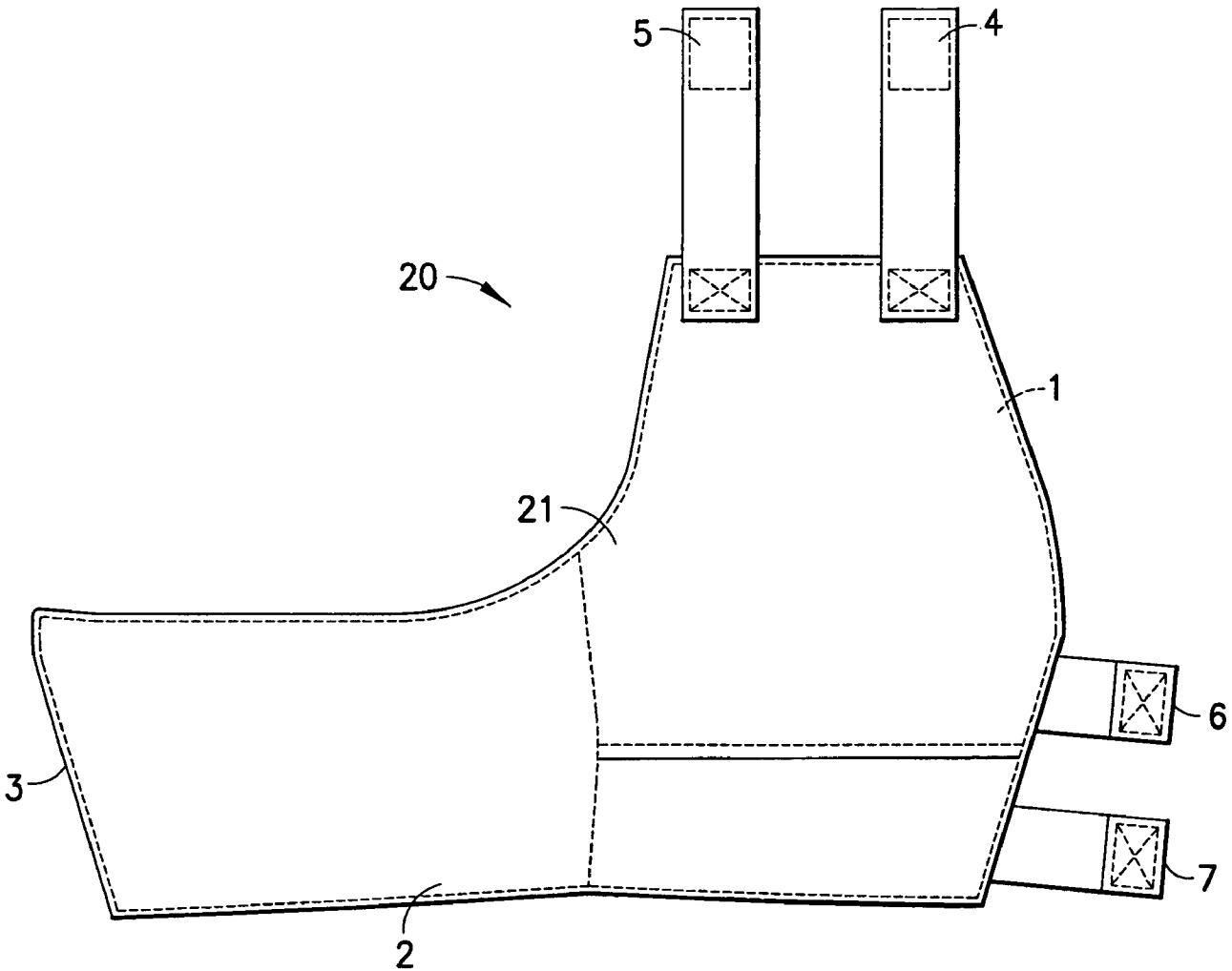
FIGS. 6 and 7 are illustrations of an alternative embodiment of the present invention where
Figure 7:
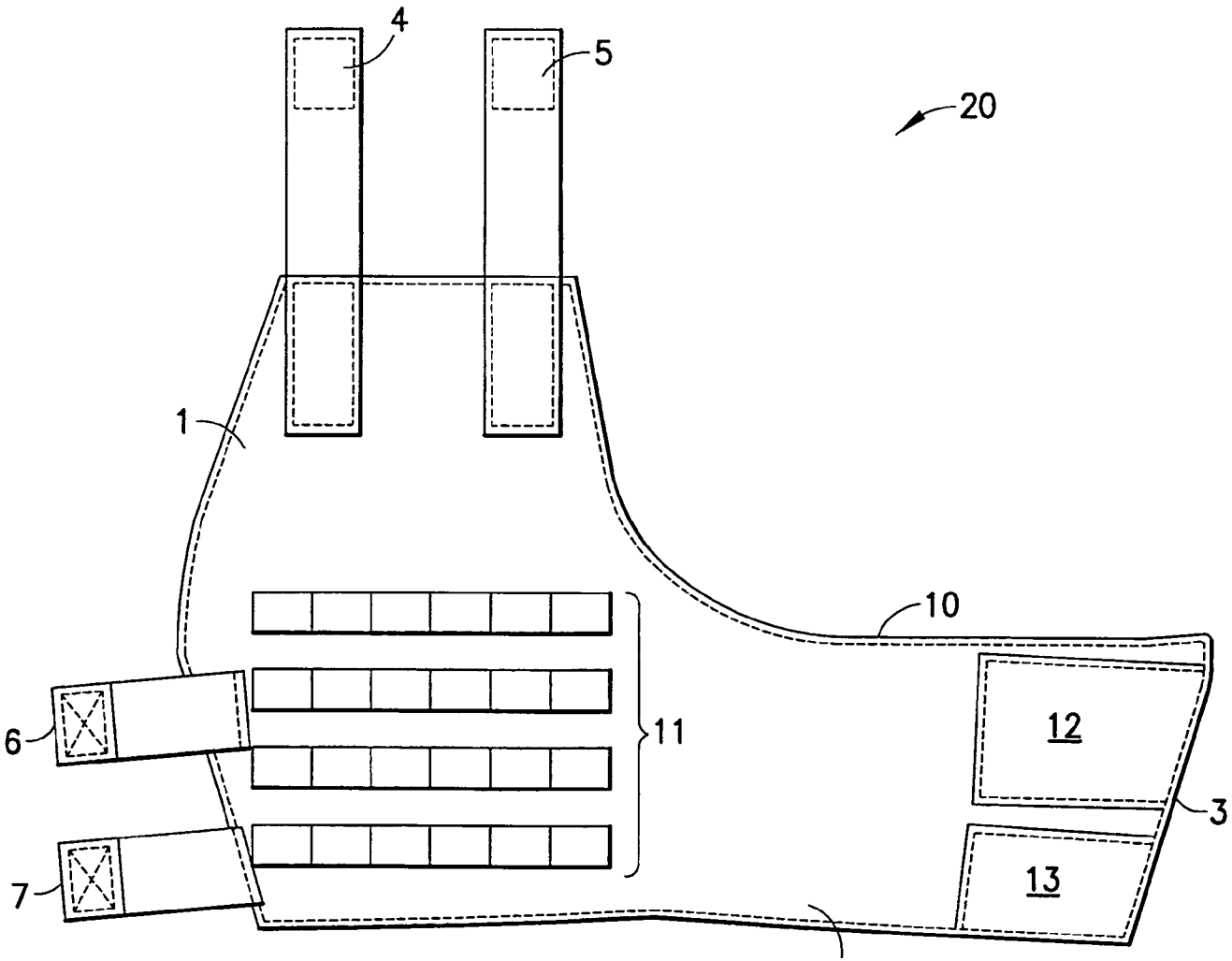

FIG. 6 illustrates shows straps 4 and 5 situated at the upper portion of the garment allowing a user to attach the garment by wrapping the straps 4 and 5 underneath and then over a user's duty belt. As shown in FIG. 6, the garment 20 is substantially prevented from shifting during wear and extreme conditions, while substantially diminishing the problems of slipping and rolling, which is typically found in soft, flexible body-armor. FIG. 6 also illustrates the smooth interior surface 21 of the garment which is next to the user's leg. FIG. 7 shows the straps 6 and 7 secured at one or more attachment points 12 and 13 which are in this embodiment, for example, Velcro patches at the upper portion of the garment.

Figure 8:
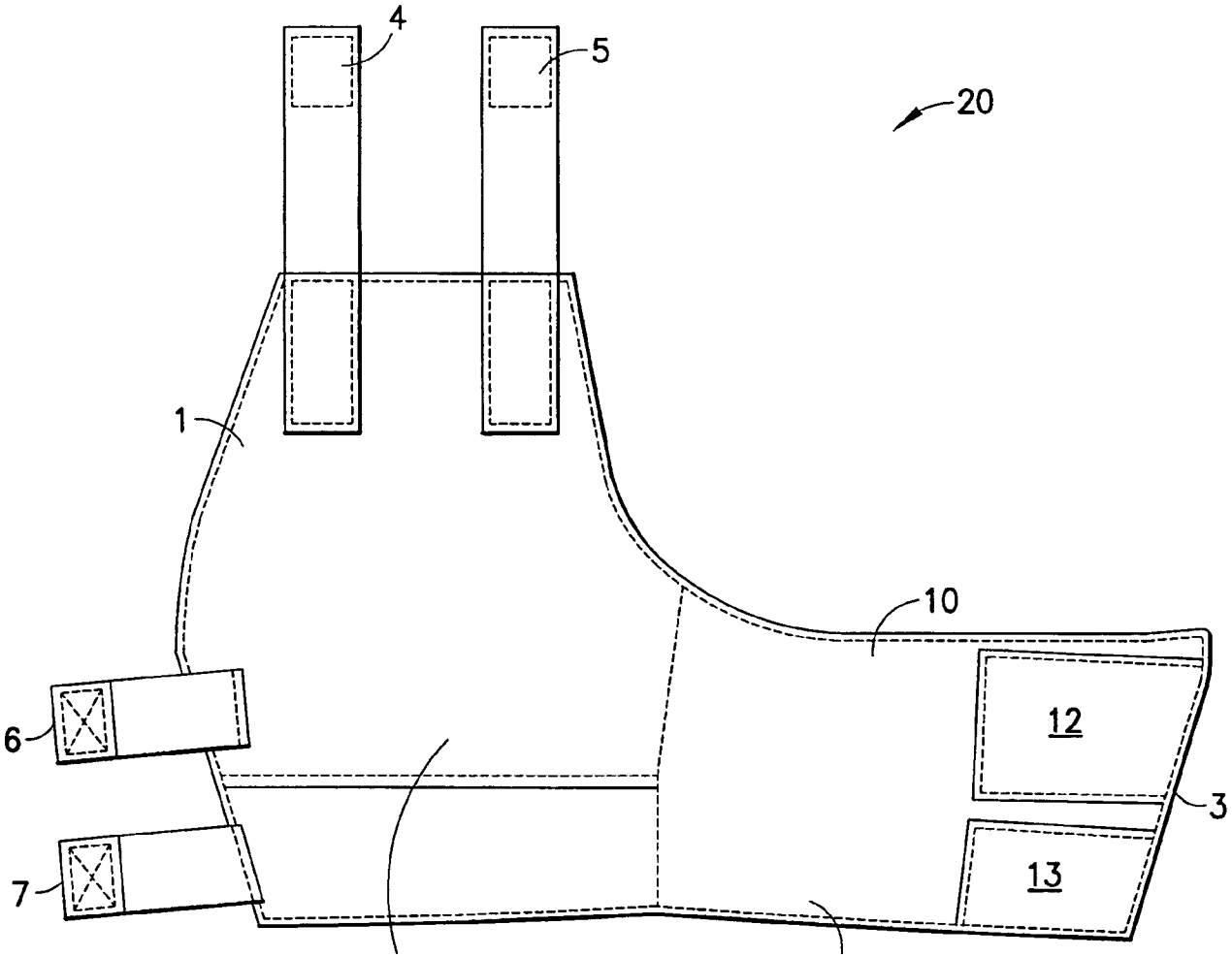
FIGS. 8 and 9 are illustrations of one embodiment of the present invention where
Figure 9:
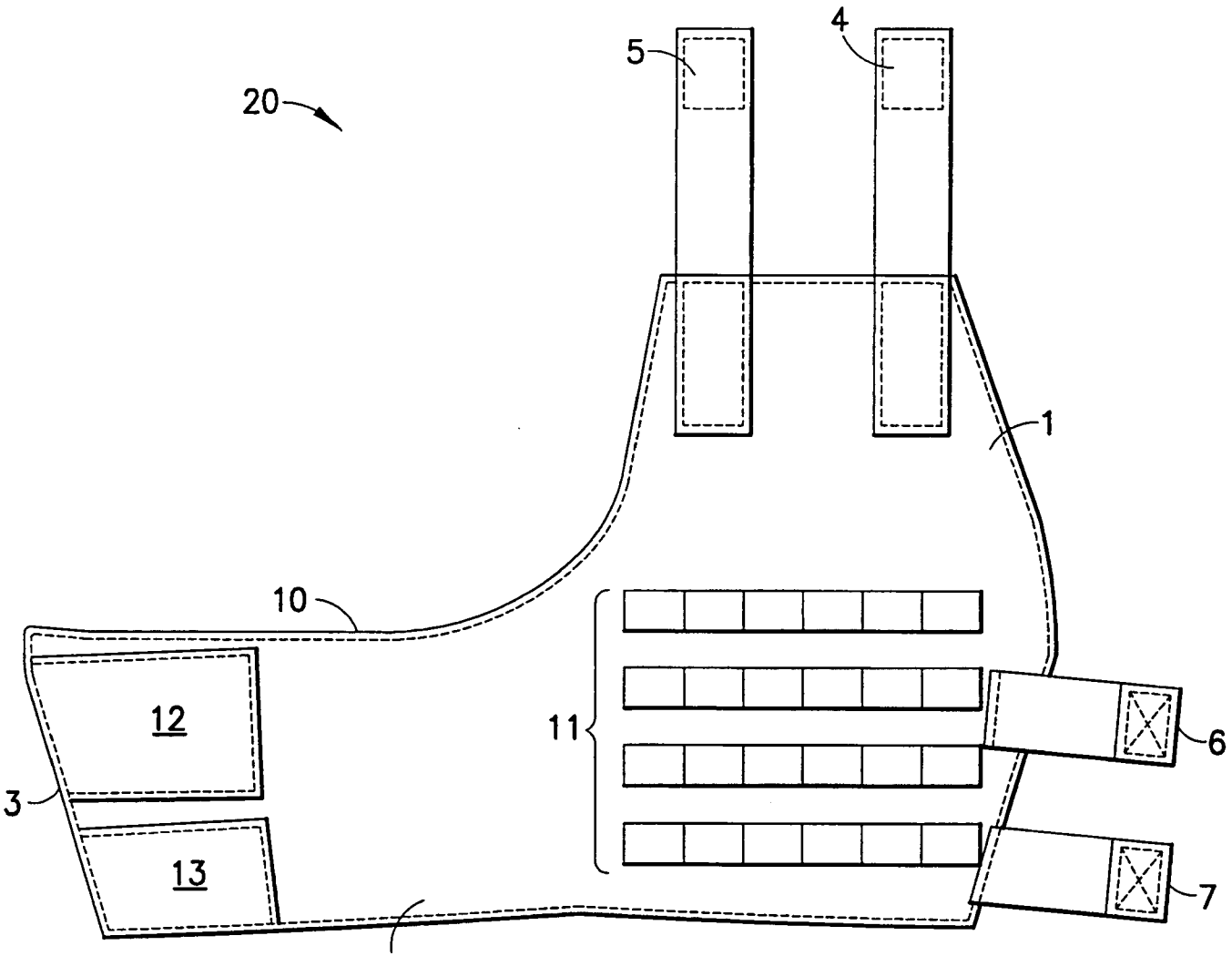

In a different embodiment, one or more straps attached to a first side of the garment are fixed at a second side of the garment, securing the bullet-resistant garment on the thigh of the user. In such an embodiment, the garment is fitted to the user in a secure, comfortable manner, allowing a full range of movement from the abdomen through the leg. FIG. 8 shows the form of the garment. FIG. 8 illustrates the smooth interior surface 21 of the garment. FIG. 9 shows one embodiment of the present invention, in which there are one or more straps 6 and 7 attached to a first side 3 of the garment on the lower portion 2 of the garment. FIG. 9 further illustrates the attachment points 12 and 13 in which at least one strap 6 or 7 secures the garment to the user. In one embodiment, as shown in FIG. 9, the straps 6 and 7 are secured by a means of attachment, for example, Velcro patches 12 and 13. In one embodiment shown in FIG. 9, the lower portion 2 of the garment 20 is wrapped around the thigh and is secured by at least one or more straps 6 and 7 and one or more patches 12 and 13 about the leg of the user. FIG. 9 further shows one or more receptacles 11 incorporated on the garment to hold items.

In a different embodiment, the garment incorporates one or more receptacles for carrying, for example, a magazine of ammunition, providing a convenient method of transporting articles in combat. FIG. 1 illustrates an example of a holding receptacle 11 incorporated on an embodiment of the present invention. FIGS. 2,3,4,5,7 and 9 further illustrate different receptacles 11 incorporated onto the bullet-resistant garment of the present invention.

In yet another embodiment, the garment incorporates a receptacle for carrying one or more weapons, for example, a handgun, eliminating the need for the user to put on an additional gun belt in addition to the user's clothing and bullet-resistant garments. FIG. 2 illustrates one example of how a receptacle 11 for carrying a weapon, in this example a handgun, may be incorporated on an embodiment of the present invention.

In a different embodiment, one or more Velcro straps provide the user with the ability to quickly don and/or quickly remove the garment. In a further embodiment, the lower portion of the garment is wrapped around the thigh of the user and secured about the leg, for example, by one or more Velcro straps. In yet a further embodiment, the lower portion of the garment is wrapped across the hamstring to provide maximum protection and is secured, for example, by one or more metal snaps.

In an additional embodiment, the garment is incorporated into a battle dress uniform. In a further embodiment, the garment is constructed of one continuous mass of soft body armor. In a different embodiment, the garment is constructed of one or more pieces of soft body armor which are joined together by, for example, stitching or flexible, adjustable straps. In yet a further embodiment, the garment is constructed with one or more compartments for placing one or more hard body armor plates.

Referring now to FIGS. 1, 2, 3 and 4, illustrations of a bullet-resistant garment according to an embodiment of the present invention are shown (FIG. 1 shows a right leg bullet-resistant garment, incorporating a receptacle for transporting items on the external face of the bullet-resistant garment; FIG. 2 shows a right leg bullet-resistant garment incorporating a receptacle for holding a weapon; FIG. 3 shows a right leg bullet-resistant garment incorporating a receptacle on the external face of the bullet-resistant garment; FIG. 4 also shows a right leg bullet-resistant garment incorporating what can be an ammunition carrying receptacle on the external face of the bullet-resistant garment). As seen in these Figs., the garment is particularly adapted for protecting the lower body of the user. In one example (which example is intended to be illustrative and not restrictive), the external surface of the garment is enhanced with a receptacle for holding a weapon or ammunition.

Referring now to FIG. 5, a photograph of a front view of a bullet-resistant garment according to an embodiment of the present invention is shown. As seen in this Fig., the garment is particularly adapted for protecting the lower body, including the leg and abdominal regions of the body (FIG. 5 shows the external face of a right leg bullet-resistant garment which incorporates a receptacle to hold items). In one example (which example is intended to be illustrative and not restrictive), the receptacle may be used for storing rounds of ammunition. In another example, a pocket may be constructed within the bullet-resistant garment into which a "hard body armor" plate may be inserted.

Referring now to FIGS. 6 and 7, corresponding drawings of the interior and exterior faces of a right leg bullet-resistant garment according to another embodiment of the present invention are shown. As seen in these Figs., the garment is particularly adapted for protecting the lower body of the user. FIG. 7 shows the external face of a right leg bullet-resistant garment which incorporates a receptacle to hold items. In one example (which example is intended to be illustrative and not restrictive), the receptacle can hold rounds of ammunition. In another example, a pocket may be constructed within the bullet-resistant garment into which a "hard body armor" plate may be inserted.

Referring now to FIGS. 8 and 9, the interior and exterior faces of a left leg bullet-resistant garment of the type of FIGS. 6 and 7, respectively, is shown. As in FIGS. 6 and 7, in FIGS. 8 and 9, corresponding drawings of the interior and exterior faces of the left leg bullet-resistant garment according to another embodiment of the present invention are shown. As seen in these Figs., the garment is particularly adapted for protecting the lower body of the user. FIG. 9 shows the external face of the left leg bullet-resistant garment which incorporates a receptacle for holding items. In one example (which example is intended to be illustrative and not restrictive), the receptacle can be used for holding rounds of ammunition. In another example, a pocket may be constructed within the bullet-resistant garment into which a "hard body armor" plate may be inserted.

Of note, a bullet-resistant garment according to the present invention (e.g., a bullet-resistant garment particularly adapted for protecting the lower body) may be used "stand-alone" or may be integrated (e.g., into a 1 piece system) with one or more other bullet-resistant garments (e.g., a bullet resistant vest). In one example (which example is intended to be illustrative and not restrictive), the integration of the bullet-resistant garment according to the present invention with one or more other bullet-resistant garments may be carried out using a mechanism selected from the group including, but not limited to: (a) one or more snaps; (b) one or more zippers; (c) one or more hook-and-loop fasteners; (d) one or more pockets; (e) one or more elastic members; (f) one or more buckles; and/or (g) one or more Velcro members.

While a number of embodiments of the present invention have been described, it is understood that these embodiments are illustrative only, and not restrictive, and that many modifications may become apparent to those of ordinary skill in the art. For example, while the garments of the present invention have been described principally as bullet-resistant, the garments may also (or instead) be designed to be resistant to fragmentation, ballistic threats, blunt trauma, stab/slash threats and/or sharp/blunt weapons (e.g., knives, clubs, etc.). Further, a bullet-resistant garment according to the present invention may be designed such that certain components are reusable. Further still, the present invention may be used to provide multiple levels of protection (or, if desired, the same levels of protection) in different anatomical regions.

Further still, the present invention may be designed such that certain "hard body armor," of relatively inflexible material (e.g., one or more ceramic plates), may be carried in pocket(s) in the garment to enhance the protection supplied to the user. Further still, the bullet-resistant garment of the present invention may utilize, for example (which example is intended to be illustrative and not restrictive), wovens, unidirectionals, non-ballistic fabrics or any combination thereof. Further still, various attachment mechanisms may be provided for attaching guns, flashlights and/or other equipment. Further still, the present invention may be used by the military and/or law enforcement. Further still, the present invention may be used with any size or shape hard armor plates (e.g., the present invention may be utilized with XSmall hard armor plates to provide additional protection under the arms and/or on the shoulders). Further still, any steps relating to manufacture and/or use may be performed in any desired order.

What is claimed is:

1. A garment comprising:

a bullet-resistant soft body armor, having an upper portion for covering at least a portion of a lower body of a user, having a lower portion located in proximity to the upper portion which is sufficiently elongated such that the lower portion wraps around to cover at least a portion of a leg of the user; the lower portion having a first and second side, the first side for wrapping around the leg of the user; the second side having an attachment mechanism for securing to the first side around the leg of the user;

an attachment mechanism located at the upper portion of the garment wherein the mechanism secures the garment to the user; and at least one receptacle to hold at least one item.

2. The garment of claim 1 wherein the lower body of the user is a lower torso area including at least a thigh and abdomen.

3. The garment of claim 1 wherein the attachment mechanism located at the upper portion of the garment is at least one strap on the upper portion of the garment that is fastened to the user's belt or pants to secure the garment on the user.

4. The garment of claim 3 wherein the strap is flexible.

5. The garment of claim 1 wherein the attachment mechanism for securing to the first side around the leg of the user is adjustable.

6. The garment of claim 5 wherein the attachment mechanism is selected from the group consisting of at least one: (a) snap; (b) zipper; (c) hook-and-fastener; and (d) buckle.

7. The garment of claim 1 wherein the receptacle includes one or more receptacles for carrying a magazine of ammunition, a gun or a weapon.

8. The garment of claim 1 wherein the lower body of the user is a calf.

9. The garment of claim 1 wherein the lower body of the user is a knee.

10. The garment of claim 1 wherein the lower body of the user is a thigh and knee.

* * * * *